United States Patent [19]

Mostosi

[11] Patent Number: 4,586,011

[45] Date of Patent: Apr. 29, 1986

[54] CURRENT-LIMITER ELECTRIC SWITCH HAVING A TELECONTROL SUITABLE FOR A VERY HIGH NUMBER OF SWITCHING OPERATIONS

[75] Inventor: Angelo Mostosi, Bergamo, Italy

[73] Assignee: SACE S.p.A. Costrusioni Elettromeccaniche, Bergamo, Italy

[21] Appl. No.: 629,081

[22] Filed: Jul. 9, 1984

[30] Foreign Application Priority Data

Jul. 27, 1983 [IT] Italy ..... 22511/83[U]

[51] Int. Cl.[4] ..... H01H 75/00; H01H 77/00; H01H 83/00

[52] U.S. Cl. ..... 335/6; 335/16; 361/115

[58] Field of Search ..... 335/6, 16, 20; 337/6; 361/115, 139

[56] References Cited

U.S. PATENT DOCUMENTS 4,495,538 1/1985 Thomas ..... 335/6

FOREIGN PATENT DOCUMENTS 592424 2/1934 Fed. Rep. of Germany .
738413 8/1943 Fed. Rep. of Germany .
1194956 6/1965 Fed. Rep. of Germany .
7633916 6/1977 France .
7734366 6/1979 France .
242021 9/1946 Switzerland .
242026 9/1946 Switzerland .

*Primary Examiner*—Harold Broome
*Attorney, Agent, or Firm*—Diller, Ramik & Wight

[57] ABSTRACT

In a current-limiter electric switch having fixed contacts, movable contacts, remote control means active upon the movable-contact-carrier against spring bias, thermomagnetic protection means being also provided, the remote control means is a solenoid the core of which is directly connected to the movable-contact-carrier and in the excitation circuit of the solenoid contacts are provided, which are opened when controlled by the thermomagnetic protection devices to have the solenoid dropped in the case of overcurrents which cause said protection devices to enter action.

15 Claims, 1 Drawing Figure

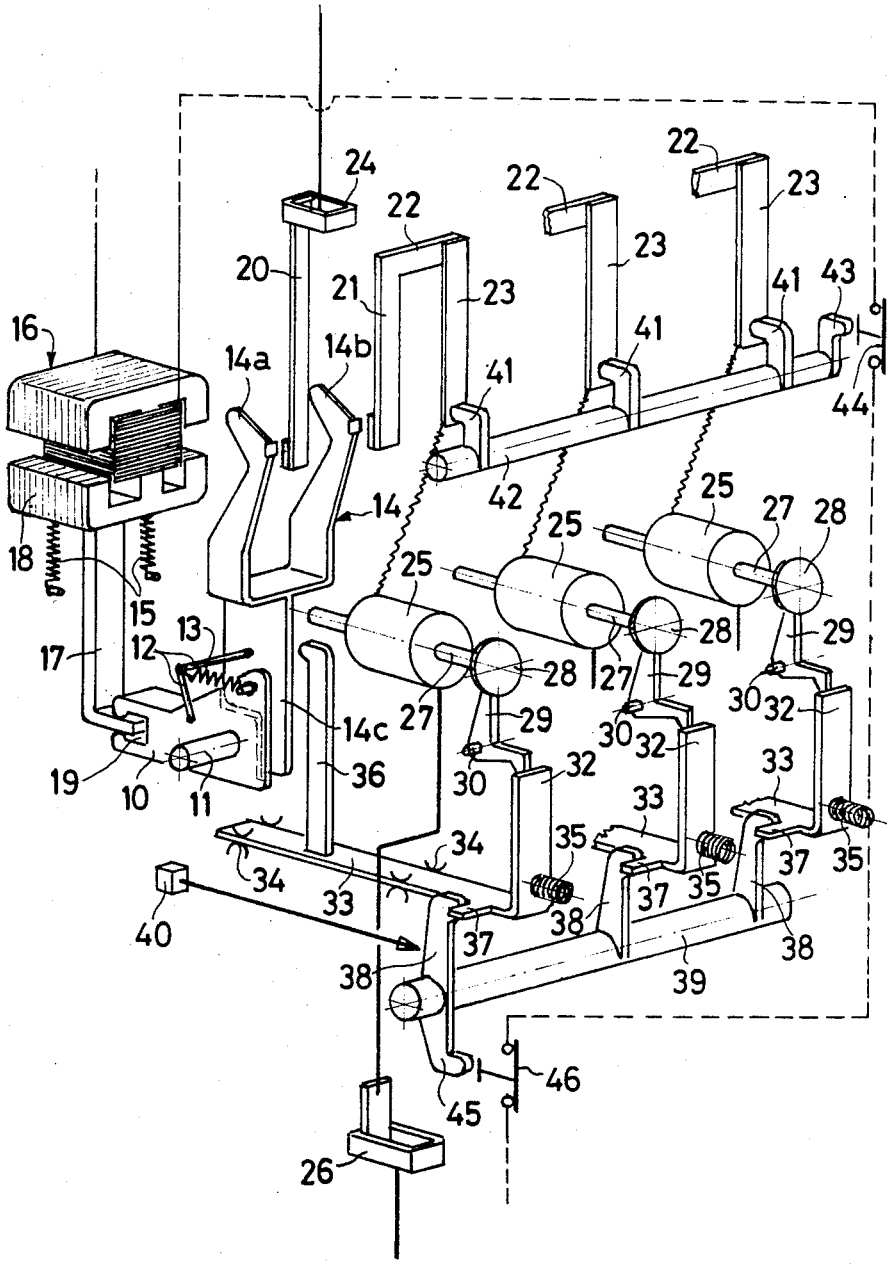
24
22
22
22
23
23
23
20
21
41
43
16
14a
14b
41
41
44
42
14
25
27
28
18
25
25
15
28
29
13
17
12
28
27
29
30
32
14c
27
29
30
32
19
10
11
36
30
32
33
33
34
35
37
35
34
33
35
37
38
40
37
38
38
39
46
45
26

CURRENT-LIMITER ELECTRIC SWITCH HAVING A TELECONTROL SUITABLE FOR A VERY HIGH NUMBER OF SWITCHING OPERATIONS

This invention relates to a current-limiter electric switch having a telecontrol suitable for a very high number of switching operations.

Current-limiter switches are known, which are characterized by a high interrupting capacity, and which, in addition to being protected against fault currents of very strong an intensity, which is effected by the instantaneous opening of the contacts by electrodynamic repulsion to be rendered particularly efficient (such as for example in the U.S. Pat. No. 3,953,811), are generally equipped with thermomagnetic safety devices adapted to offer a protection against overloads of lesser intensity (so called "thermal" and "magnetic" protection). Current-limiter switches of the kind referred to above have, usually, telecontrol mechanisms for actuating the movable contacts, which are rather intricate so that they do not lend themselves to a high number of switching operations (see for example the published European patent application No. 62369).

This invention has as its objective to provide in a constructionally simple way a current-limiting apparatus having a high interrupting capacity and an extremely simplified remote controlling mechanism which is adapted for a high number of switching operations, so that a switch so conceived is particularly suitable for the remote control of motors or other machines while tendering an overall protection against overloads and shortcircuits.

According to the invention, this objective is achieved by providing a current-limiter switch which comprises fixed contacts, a contact-carrier for movable contacts which are mounted thereon so as to be capable of being individually brought from the closed position of said contact-carrier to the opening position by electrodynamic repulsion, telecontrolling means adapted to act upon said movable-contact carrier so as to shift it to its closed position against the bias of resilient means which tend to bring it and to hold it in the open position, as well as thermomagnetic protection devices, characterized in that said telecontrolling means consist of a solenoid having its movable armature directly coupled to the movable-contact-carrier and in that in the excitation circuit of said solenoid contacts are inserted which can be opened upon a command by said thermomagnetic protection devices to cause the solenoid to drop out when overcurrents arise which start said protection devices.

The thermal protection device can consist of bimetallic couples which are adapted to become deformed as an overload current of a preselected value flows therethrough and the magnetic protection device can consists of electromagnets the movable cores of which are attracted as fault currents flow therethrough starting from a preselected threshold value of said fault currents which is greater than the value of the overload current. The bimetallic couples and the electromagnets are inserted, for each polarity, in series relative to the circuit of the fixed and the movable contacts of the switch.

In such a case, said bimetallic couples can act in parallel and directly on a contact inserted in the excitation circuit of the solenoid, whereas the movable cores of the electromagnets can act in parallel on another contact which is inserted in said circuit in series with the former contact, through tripping and holding mechanisms for the second contact in its open position, so that the restoration of the closed position of said second contact must take place by a special manual operation on the spot or by remote control.

The characteristics and the advantages of the remote-controlled limiter switch according to this invention will become more clearly apparent from the ensuing description which is given with reference to the accompanying drawing, the single Figure of which shows a principle layout of the device in its open position.

It should be noted that in the layout in question there are illustrated only the contacts of one polarity of the device, being it understood that those of the other polarities are embodied in very much the same way.

The movable contact carrier of the apparatus comprises a rotatable body 10 which is adapted to be rotated about an axle 11. On said rotatable body 10 there are mounted, conventionally (see for example U.S. Pat. No. 3,953,811 and published European patent application No. 62369), by the agency of connecting rods 12 and springs 13, the movable contacts, one only of which is shown in the drawing and is indicated at 14. The contact 14 is a fork contact, having two prongs **14*a* and 14*b* and a tail piece 14*c* which, through the connecting rods 12 and springs 13 is held resting adherently to the rotatable body 10, the layout being such that with the contact carrier 10 in the closed position, the fork contact 14 is enabled to be moved relative to the body 10** and to reach the open position, for example due to the effect of electrodynamic repulsive forces when fault currents of a very high intensity flow.

Such opening action, for example one due to self-repulsion, is permitted to every movable contact, independently of the other ones.

Upon the movable contact-carrier consisting of the rotatable body 10 and the movable forked contacts 14, a solenoid can become active, as generally indicated at 16, through a rod 17 integral with the movable section 18 of the solenoid 16, since the free end of the rod 17, which is bent, is inserted in, and retained by, a slot 19 of the rotatable body 10, the slot being eccentrically mounted relative to the rotation axle 11.

The movable portion 18 of the solenoid 16 is subjected to the bias of springs 15 which tend to hold the movable section 18 spaced apart from the fixed portion (as shown in the drawing). By energizing the solenoid 16, the rod 17 of its movable section 18 causes the rotation of the movable body 10 in the clockwise direction as viewed in the drawing, by overcoming the bias of the springs 15, so that the movable contacts 14 are shifted to their closed position.

When the solenoid 16 is de-energized, the springs 15 pull the movable portion 18 of solenoid 16 downwardly from the fixed portion and, through the rod 17, the movable body 10 is rotated in the opposite direction so as to bring the movable contacts 14 back to the open position again.

The two prongs **14*a* and 14*b* of the movable contact 14 of each polarity establish the continuity of the circuit with a fixed contact 20 and another fixed contact 21, respectively. The fixed contact 21 is electrically connected through a lug 22 to a bimetallic couple 23. The fixed contact 20 is connected to a terminal 24, whereas the bimetallic couple 23 is connected to an electromagnet 25 which, in its turn, is connected to a second terminal 26. The electromagnet 25 has a movable core consisting of a stem 27 which carries at either end a disc 28. The disc 28 cooperates with a lever 29 which is integral with a rotatable pin 30**.

In the example shown herein, since a triple pole switch is in the question, there are three distinct levers 29, each of which is adapted to interact with the bent end 32 of a rod 33 slidably guided within guides 34 and subjected to the bias of a spring 35. The bent end 32 of each rod 33 rests against the end of its respective lever 29 when said lever 29 is in the position shown in the drawing. If the lever 29 is, instead, rotated counterclockwise about the axis of its pin 30 as a result of the leftward shift of the stem 27 and the disc 28 of the electromagnet 25 concerned, the end of the lever 29 does no longer abut the bent end 32 of the rod 33 so that the rod 33, under the action of its spring 35, is thrust and pushed leftwards. In this shifted position, a tooth 36 integral with the rod 33 can act upon the tail section 14*c* of the relevant movable contact 14 to bring it to the open position and to hold it therein.

In addition, each rod 33, by a tooth 37, interacts with a lever 38 integral with a common arbor 39. When one of the rods 33 is shifted leftwards, the arbor 39 is rotated counterclockwise. Upon the tripping of one of the rods 33 as described above, to restore the hooking up of the bent end 32 and the relevant lever 29, a reset push-button 40 is provided, which is capable of acting upon one of the levers 38 so as to have it rotated together with the arbor 39 and the other levers 38 integral therewith, in the clockwise direction whereby the rod 33, through the tooth 37, is shifted towards the right against the bias of the spring 35 until enabling the lever 29 concerned to return to its position in which it may abut the end of the rod 33.

In the example shown herein, this resetting operation takes place manually, but with simple and appropriate means, the rest can be carried out also by remote control.

Now, according to the present invention, each bimetallic couple 23 can act upon a relative lever 41 integral with a rotatable arbor 42, which, through an arm 43, can act, in its turn, upon a first movable snapping contact 44 inserted in the excitation circuit of the solenoid 16 (as shown in the drawing in dotted lines) and this snapping contact 44, in the normal undeformed condition of the bimetallic couple 23, holds that circuit closed, whereas the deformation of one of the bimetallic couples 23, for values of current intensity above a certain threshold value, causes the opening of the snapping contact 44 and thus the cutoff of the excitation circuit of the solenoid 16. It is thus clear that, as the overload current threshold is overtaken, the solenoid 16 is de-energized and the movable-contact-carrier 10 of the device is brought to its open position. The reset of the energization condition of the solenoid 16 and that of the closed position of the movable-contact-carrier of the device can take place automatically as the deformed bimetallic couple 23 is brought back to its nondeformed configuration once again, but a reset could also be provided which requires a manual operation. The electromagnet 25 associated with the movable contact 14 of each polarity is so embodied as to enter action under fault currents starting from a preselected threshold value exceeding the value of the overload current. As such a current threshold is overtaken, the electromagnet 25 shifts towards the left its movable core, that is, the stem 27 and the disc 28, the latter then causing the rotation of the lever 29, so that the lever 29 does not abut any longer the bent end 32 of the relevant rod 33. The latter, so cleared, is shfted leftwards by the spring 35. The leftward shift of the stem 27, moreover, causes, by direct mechanical action, the opening of the contact 14 associated therewith, just as in the opening due to self-repulsion.

According to the present invention, the arbor 39 which, via the levers 38 is rotated when one of the rods 33 is shifted leftwards, carries an arm 45 associated to a second contact 46, also inserted in the excitation circuit for the solenoid 16, in serial relationship with the contact 44, so that, when one of the rods 33 is cleared and shifted by the relevant spring 35, the arm 45 opens the contact 46 and thus the excitation circuit is consequently opened and the solenoid 16 and the result is, also in this case, that the movable-contact-carrier of the device is brought to the open position. The rest of the initial condition is not automatic, but requires a special manual operation on the spot, or from a remote location, as outlined above, by acting, for example, upon the rest pushbutton 40.

Lastly, in the case that a short-circuit of a very strong magnitude occurs, the movable contacts 14 of the device are instantaneously opened by electrodynamic self-repulsion because the contacts themselves are mounted independently on the movable body 10 of the movable-contact-carrier 10. Of course, if the very intense current which originates such as instantaneous opening of the contacts by self-repulsion, originates, since it flows also through the electromagnet(s) 25, also the above described clearance and shifting of the rod(s) 33, so that, through the contact 46, also the interruption of the excitation circuit of the solenoid 16 is brought about.

From the above description, it is apparent that the present invention, by virtue of the simple structure of the remote control provided threby, makes the switch adapted for use of a very high number of switching operations while concurrently being equipped with all the protections which are provided for a current limiter having a high interrupting capacity.

This result has been achieved in an extremely simple manner by inserting in the excitation circuit of the solenoid which controls the movable-contact-carrier, interruption contacts which can be actuated by the thermomagnetic protection devices and by adopting a movable-contact-carrier, the contacts of which are mounted in such a way as to permit their opening by self-repulsion.

The clearance and the "blow" shifting of one of the rods 33 in the case that the value of the fault currents is exceeded, as caused by the relative electromagnet 25 and the relative spring 35, in addition to causing, as outlined above, the opening of the contact 46 and the consequential drop of the solenoid 16 and the opening of the movable contacts 14 of the device, are exploited also to originate the "blow" mechanical opening of the movable contact 14 concerned through the tooth 36 integral with the relevant rod 33.

The device according to the invention has been illustrated only on the basis of a principle layout and it is understood that its practical constructional embodiments may be reduced to practice in several ways by one skilled in the art.

I claim:

1. A current-limiter switch comprising fixed and movable contacts adapted to move between open and closed positions, a movable carrier, means for mounting said movable contacts for movement relative to said movable carrier, a solenoid for moving said movable carrier through its associated armature and thereby moving the movable contacts thereof to the closed position upon energization of said solenoid, an electrical circuit for energizing said solenoid, and means for responding to a predetermined current threshold to open said electrical circuit whereby electrodynamic repulsion between said fixed and movable contacts move said movable contacts to said open position.

2. The current-limiter switch as defined in claim 1 wherein said predetermined current responding means includes a series connected bimetallic couple and an electromagnet in a circuit of said fixed and movable contacts, said electromagnet having a movable core adapted to actuate an associated "blow" clearing mechanism, first and second series connected contacts in said solenoid energizing electrical circuit and also in parallel to said respective bimetallic couple and said "blow" clearing mechanism, and a pushbutton for resetting said "blow" clearing mechanism.

3. The current-limiter switch as defined in claim 1 including a rod connecting said armature to said movable carrier, and spring means for normally biasing said armature in a direction to maintain said movable contacts in the open position thereof through said movable carrier.

4. The current-limiter switch as defined in claim 1 including a rod connecting said armature to said movable carrier, spring means for normally biasing said armature in a direction to maintain said movable contacts in the open position thereof through said movable carrier, and means for releasably insertably coupling said rod to said movable carrier.

5. The current-limiter switch as defined in claim 1 wherein said responding means includes a shaft, and bimetallic means responsive to predetermined current through said fixed and movable contacts in the closed position thereof for opening said solenoid energizing electrical circuit whereby said solenoid is de-energized.

6. The current-limiter switch as defined in claim 1 including another contact in said solenoid energizing electrical circuit, said responding means includes a shaft, and bimetallic means responsive to a predetermined current through said fixed and movable contacts in the closed position thereof for opening said another movable contact to de-energize said solenoid energizing electrical circuit whereby said solenoid is deenergized.

7. The current-limiter switch as defined in claim 1 including another movable contact in said solenoid energizing electrical circuit, and said responding means includes a rotatable shaft carrying first and second arms and bimetallic means responsive to predetermined current through said fixed and movable contacts in the closed position thereof to respectively contact said first arm causing rotation of said shaft and the opening of said another movable contact by said second arm.

8. The current-limiter switch as defined in claim 1 wherein said predetermined current responding means includes a series connected bimetallic couple and an electromagnet in a circuit of said fixed and movable contacts, said electromagnet having a movable core adapted to actuate an associated "blow" clearing mechanism, first and second series connected contacts in said solenoid energizing electrical circuit and also in parallel to said respective bimetallic couple and said "blow" clearing mechanism, and a pushbutton for resetting said "blow" clearing mechanism, said movable core includes a stem carrying a disc, said stem operates said first-mentioned movable contact to move the same to said open position, and said disc concurrently operates through a lever to operate a rod of said "blow" clearing mechanism for opening said second series connected contact thereby de-energizing said solenoid energizing electrical circuit.

9. The current-limiter switch as defined in claim 1 including a contact in said solenoid energizing electrical circuit, and said responding means includes bimetallic means for opening said last-mentioned contact.

10. The current-limiter switch as defined in claim 1 including a contact in said solenoid energizing electrical circuit, and said responding means includes bimetallic means in circuit with electromagnetic means for opening said last-mentioned contact.

11. The current-limiter switch as defined in claim 1 including a member movable to move said movable contacts to the open position thereof, and said responding means includes bimetallic means in circuit with the electromagnetic means for moving said last-mentioned member to open said movable contacts.

12. The current-limiter switch as defined in claim 1 including a first contact in said solenoid energizing electrical circuit, said responding means includes bimetallic means for opening said first contact, a second contact in said solenoid energizing electrical circuit, and said bimetallic means opens said second contact.

13. The current-limiter switch as defined in claim 1 including a contact in said solenoid energizing electrical circuit, said responding means includes bimetallic means for opening said last-mentioned contact, a member movable to move said movable contacts to the open position thereof, and said bimetallic means is in circuit with electromagnetic means for moving said last-mentioned member to open said movable contacts.

14. The current-limiter switch as defined in claim 1 including a contact in said solenoid energizing electrical circuit, said responding means includes bimetallic means in circuit with electromagnetic means for opening said last-mentioned contact, a member movable to move said movable contacts to the open position thereof, and said electromagnetic means further move said last-mentioned member to open said movable contacts.

15. The current-limiter switch as defined in claim 12 including a member movable to move said movable contacts to the open position thereof, and said bimetallic means further move said last-mentioned member to open said movable contacts.

* * * * *